US010365024B2

(12) United States Patent
Rabe

(10) Patent No.: US 10,365,024 B2
(45) Date of Patent: Jul. 30, 2019

(54) REMOVAL DEVICE FOR A FLUID

(71) Applicant: Inficon GmbH, Cologne (DE)

(72) Inventor: Gerd H. Rabe, Meinerzhagen (DE)

(73) Assignee: INFICON GmbH, Cologne (DE)

( * ) Notice: Subject to any disclaimer, the term of this patent is extended or adjusted under 35 U.S.C. 154(b) by 87 days.

(21) Appl. No.: 14/398,107

(22) PCT Filed: May 2, 2013

(86) PCT No.: PCT/EP2013/059176
§ 371 (c)(1),
(2) Date: Oct. 30, 2014

(87) PCT Pub. No.: WO2013/167468
PCT Pub. Date: Nov. 14, 2013

(65) Prior Publication Data

US 2015/0107288 A1 Apr. 23, 2015

(30) Foreign Application Priority Data

May 8, 2012 (DE) ..... 10 2012 207 650

(51) Int. Cl.
*F25B 1/00* (2006.01)
*F25B 45/00* (2006.01)
(Continued)

(52) U.S. Cl.
CPC ..... *F25B 45/00* (2013.01); *F25B 1/005* (2013.01); *F28D 1/0477* (2013.01); *F28F 1/32* (2013.01);
(Continued)

(58) Field of Classification Search
CPC ..... F25B 2500/01; F25B 45/00; F25B 1/005; F25B 2345/002; F28D 1/0477;
(Continued)

(56) References Cited

U.S. PATENT DOCUMENTS 1,817,948 A * 8/1931 Smith ..... F28D 1/0477 165/150
1,904,555 A * 4/1933 Soehner ..... F28D 1/0477 165/131
(Continued)

FOREIGN PATENT DOCUMENTS

CN 2699224 Y 5/2005
JP H04 20760 A 1/1992
(Continued)

*Primary Examiner* — Edward F Landrum
*Assistant Examiner* — Daniel C Comings
(74) *Attorney, Agent, or Firm* — Kirton & McConkie; Lloyd Metcalf

(57) ABSTRACT

The invention relates to a removal device (10) for removing a fluid from a refrigeration system, comprising a cooling device (11), through which the fluid is to flow and which has a pipeline assembly (12), which has a plurality of pipeline elements (24, 26) connected to each other, a fluid inlet (28) arranged above the pipeline elements, and a fluid outlet (30) arranged below the pipeline elements, the removal device having a compressor (14), which is arranged before the cooling device (11) in the flow direction and through which the fluid can flow and which is connected to the fluid inlet (28), is easier to clean because the pipeline elements are each arranged at an inclination of an angle (alpha) from the horizontal in such a way that all fluid entering through the fluid inlet (28) is moved to the fluid outlet (30) by gravity.

16 Claims, 5 Drawing Sheets

Figure 1:
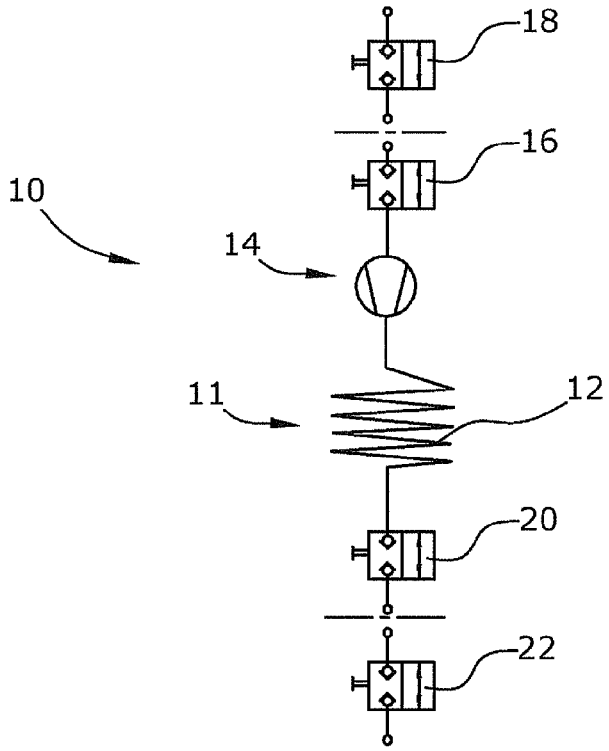

(51) Int. Cl.

| | |
|---|---|
| ***F28D 1/047*** | (2006.01) |
| ***F28F 9/007*** | (2006.01) |
| ***F28F 9/013*** | (2006.01) |
| ***F28F 1/32*** | (2006.01) |
| ***F28G 9/00*** | (2006.01) |
| *F28D 21/00* | (2006.01) |

(52) U.S. Cl.
CPC ..... *F28F 9/0131* (2013.01); *F28G 9/00* (2013.01); *F25B 2345/002* (2013.01); *F25B 2500/01* (2013.01); *F28D 2021/0061* (2013.01); *F28F 2265/22* (2013.01)

(58) Field of Classification Search
CPC .. F28D 2021/0061; F28G 9/00; F28F 9/0131; F28F 1/32; F28F 2265/22; F28F 9/007; F28F 9/013
USPC ..... 62/292, 298; 165/150
See application file for complete search history.

(56) References Cited

U.S. PATENT DOCUMENTS

| | | | | | |
|---|---|---|---|---|---|
| 2,204,613 | A * | 6/1940 | Nelson | F28D 7/08 | 165/150 |
| 3,232,070 | A * | 2/1966 | Sparano | F25B 45/00 | 62/127 |
| 3,243,969 | A | 4/1966 | Dirk | | |
| 4,492,269 | A | 1/1985 | Jennings et al. | | |
| 4,768,347 | A * | 9/1988 | Manz | F25B 45/00 | 137/487.5 |
| 4,939,905 | A * | 7/1990 | Manz | F25B 45/00 | 62/149 |
| 4,993,461 | A * | 2/1991 | Yamane | B01D 5/0039 | 141/231 |
| 5,005,375 | A * | 4/1991 | Manz | B60H 1/00571 | 137/231 |
| 5,176,187 | A | 1/1993 | Grant | | |
| 5,189,881 | A * | 3/1993 | Miles | F25B 45/00 | 165/104.19 |
| 5,390,503 | A | 2/1995 | Cheng | | |
| 6,005,772 | A * | 12/1999 | Terao | F28D 15/0233 | 165/104.21 |
| 6,260,372 | B1 * | 7/2001 | Burke | F25B 45/00 | 62/292 |
| 6,314,749 | B1 | 11/2001 | Van Steenburgh, Jr. | | |
| 6,779,359 | B2 | 8/2004 | Higami | | |
| 6,810,681 | B2 * | 11/2004 | Erisgen | F25B 45/00 | 62/77 |
| 2003/0196450 | A1 | 10/2003 | Higami | | |
| 2006/0127231 | A1 * | 6/2006 | Sundheim | F04B 27/005 | 417/234 |
| 2007/0028626 | A1 | 2/2007 | Chen | | |
| 2011/0203306 | A1 * | 8/2011 | Choi | F24H 1/142 | 62/389 |

FOREIGN PATENT DOCUMENTS

| | | | |
|---|---|---|---|
| JP | H04-093566 | A | 3/1992 |
| JP | H07-012787 | U | 1/1995 |
| JP | H07-120-111 | A | 5/1995 |
| JP | H07-178633 | A | 7/1995 |
| JP | H11-108483 | A | 4/1999 |
| JP | 2001-066023 | A | 3/2001 |
| JP | 2003-269826 | A | 9/2003 |
| JP | 2007-046869 | A | 2/2007 |
| JP | 2007-290465 | A | 11/2007 |
| JP | 2009-103393 | A | 5/2009 |

* cited by examiner

REMOVAL DEVICE FOR A FLUID

This application is a National Stage of International Application No. PCT/EP2013/059176, filed May 2, 2013, and entitled REMOVAL DEVICE FOR A FLUID, which claims the benefit of DE 10 2012 207 650.6, filed May 8, 2012. This application claims priority to and incorporates herein by reference the above-referenced applications in their entirety.

The invention relates to a removal device for removing a fluid from a refrigeration system. The removal device comprises a compressor and a cooling device through which the fluid flows, the device comprising a pipeline assembly through which the fluid flows and which has a plurality of interconnected pipeline elements. The pipeline assembly has a fluid inlet and a fluid outlet. The fluid may typically be a condensable gas. The cooling device serves to cool the compressor that withdraws condensable gases from a process. Such removal devices find application in the maintenance of refrigeration systems or air-conditioning systems, such as air-conditioning devices, for example. The basic principle of such a cooling device provides that a fluid, which has been compressed beforehand, flows through the fluid inlet into the pipeline assembly and condenses as it flows through the pipeline assembly. In the process, it gives off heat to the outside before it leaves the pipeline assembly through the fluid outlet as a liquid.

For the purpose of cleaning or maintaining the cooling device or in order to prevent various condensable liquids from mixing in different processes, the fluid must be removed completely from the pipeline assembly. For cleaning a cooling device, it is known to apply a rinsing method in which a pressurized rinsing fluid, e.g. air, flows through the pipeline assembly, the pipeline assembly later being filled with another fluid refrigerant. This requires additional pumps and valves to first pump the refrigerant from the pipeline assembly and to thereafter pump the cleaning gas through the pipelines.

It is an object of the present invention to provide a removal device for removing a fluid from a refrigeration system, which device is easier to clean. The removal device of the present invention is defined by the features of claim 1.

According thereto, the pipeline assembly comprises a plurality of interconnected pipeline elements with a fluid inlet arranged above the pipeline elements and a fluid outlet arranged below the pipeline elements, wherein the pipeline elements are each inclined under an angle $\alpha$ with respect to the horizontal plane such that, with the fluid outlet opened, all fluid entering through the fluid inlet is automatically moved towards the fluid outlet by gravity. In this regard, the angle $\alpha$ can range from 1° to 4°, preferably from 2° to 3° and in particular be about 2.5°. Due to the inclined arrangement of the pipeline elements, sequentially passed by the fluid, the fluid can flow out by the effect of gravity in the open state of the fluid outlet, without additional pumps or valves. With the fluid inlet and/or the fluid outlet open, i.e. at atmospheric pressure within the pipeline assembly, the fluid preferably is a liquid refrigerant. The fluid can flow out completely from the fluid outlet without requiring the removal device to be moved or tilted.

The pipeline elements are preferably straight and are arranged one after the other in the fluid flow direction. In this regard, the pipeline elements can be stacked on top of each other. Pipeline elements arranged one after the other in the fluid flow direction are preferably inclined relative to each other by an angle $\beta$. The angle $\beta$ can range from 1° to 9°, preferably from 3° to 7°, and in particular be about 5°. For a typical refrigerant, flow velocities are obtained that are advantageous for a uniform and complete draining of fluid from the pipeline elements.

The pipeline elements arranged one after the other in the fluid flow direction are preferably connected by U-shaped connecting pipes arranged in a plane that is inclined by an angle $\gamma$ with respect to a horizontal plane. Here, the angle $\gamma$ can range from 10° to 50°, preferably from 25° to 35°, and in particular be about 30°. Thereby, the fluid flows out completely from the bent connecting pipes when the fluid outlet is open and atmospheric pressure prevails.

The pipeline elements are advantageously arranged stacked in two different planes that are parallel to each other, the two planes being inclined both relative to a vertical plane and to a horizontal plane. The inclination angle $\delta$ of these planes relative to the vertical plane is preferably from 5° to 35°, more preferred from 15° to 25°, and in particular about 20°. In this regard, the pipeline elements arranged one after the other in the fluid flow direction should be arranged in a different one of the two planes. This results in a space-saving arrangement of the pipeline elements from which the fluid can flow out completely in the open state of the fluid outlet.

Advantageously, the cooling device is provided with cooling fins for the pipeline assembly which each have openings arranged along a first straight line and provided for the pipeline elements of the first plane, and recesses along a second straight line parallel to the first straight line and provided for the pipeline elements of the second plane. These cooling fins may be arranged side by side and in parallel with each other, the openings of the cooling fins contacting the pipeline elements of the first plane and the recesses touching none of the pipeline elements. Heat transfer only occurs between the pipeline elements of the first plane and the cooling fins. The recesses for the pipeline elements of the second plane enable a simple fastening of the cooling fins to the pipeline assembly.

Upstream of the pipeline assembly, seen in the flow direction, the cooling device is advantageously equipped with a compressor through which the fluid flows and which is connected with the fluid inlet of the pipeline arrangement. Using the compressor, the refrigerant flowing through the pipeline assembly can be compressed before flowing through the assembly, so that the refrigerant relaxes as it flows through the pipeline assembly and absorbs heat in the process.

Upstream of the compressor, seen in the flow direction, and/or downstream of the fluid outlet, seen in the flow direction, plugs that are self-closing in both directions and/or quick release couplings that are self-closing in both directions are advantageously provided.

The following is a detailed description of an embodiment of the invention with reference to the Figures.

Figure 2:
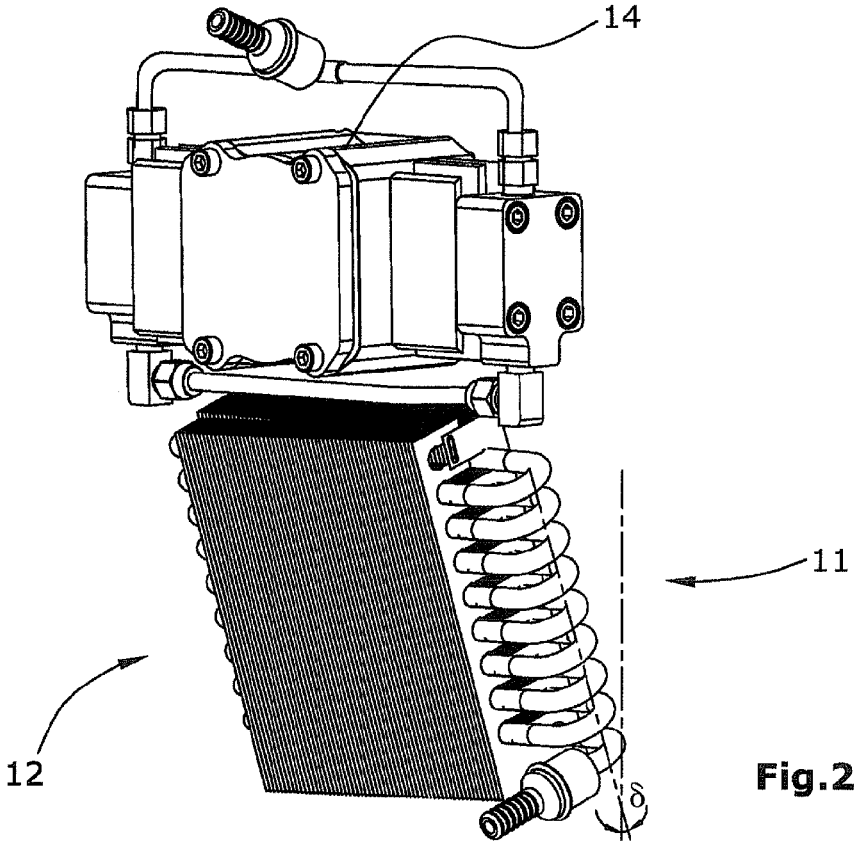
Figure 3:
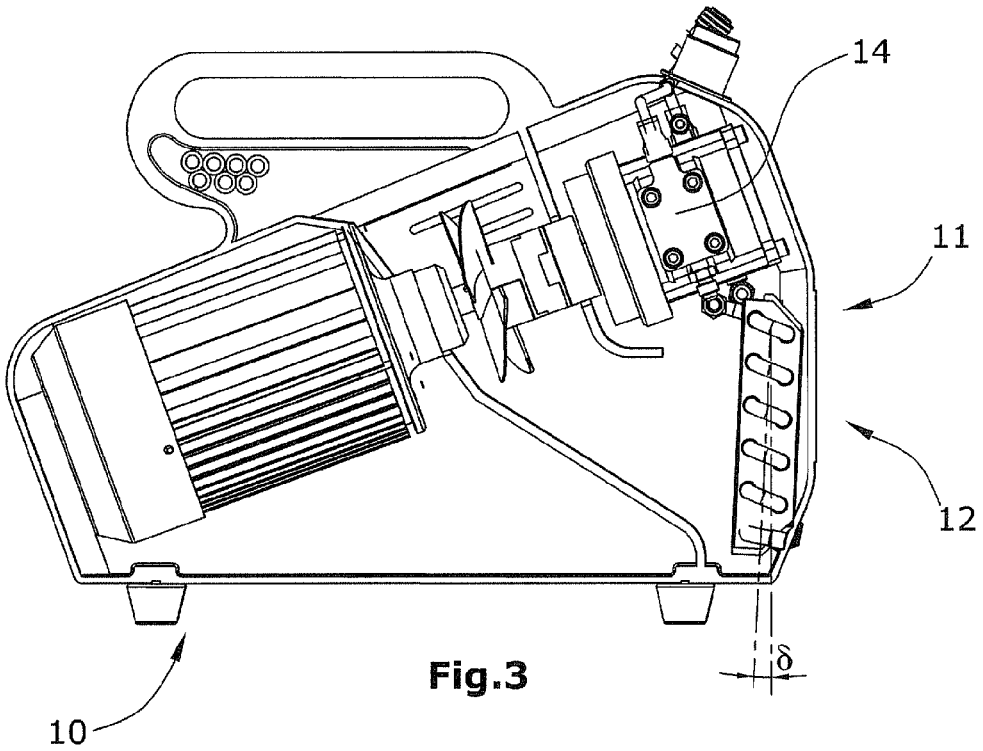
Figure 4:
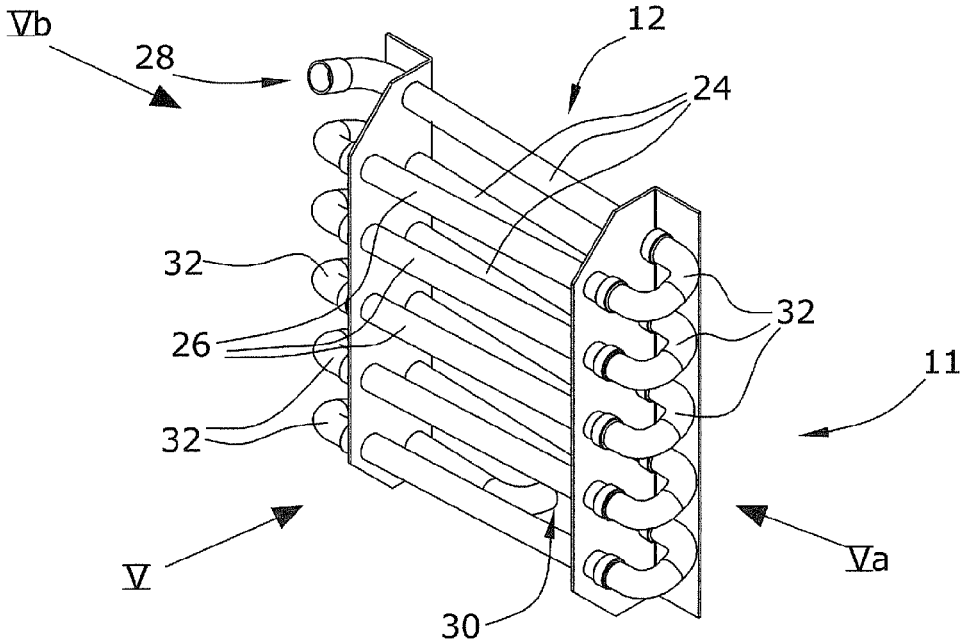
Figures 5, 5A, 5B:
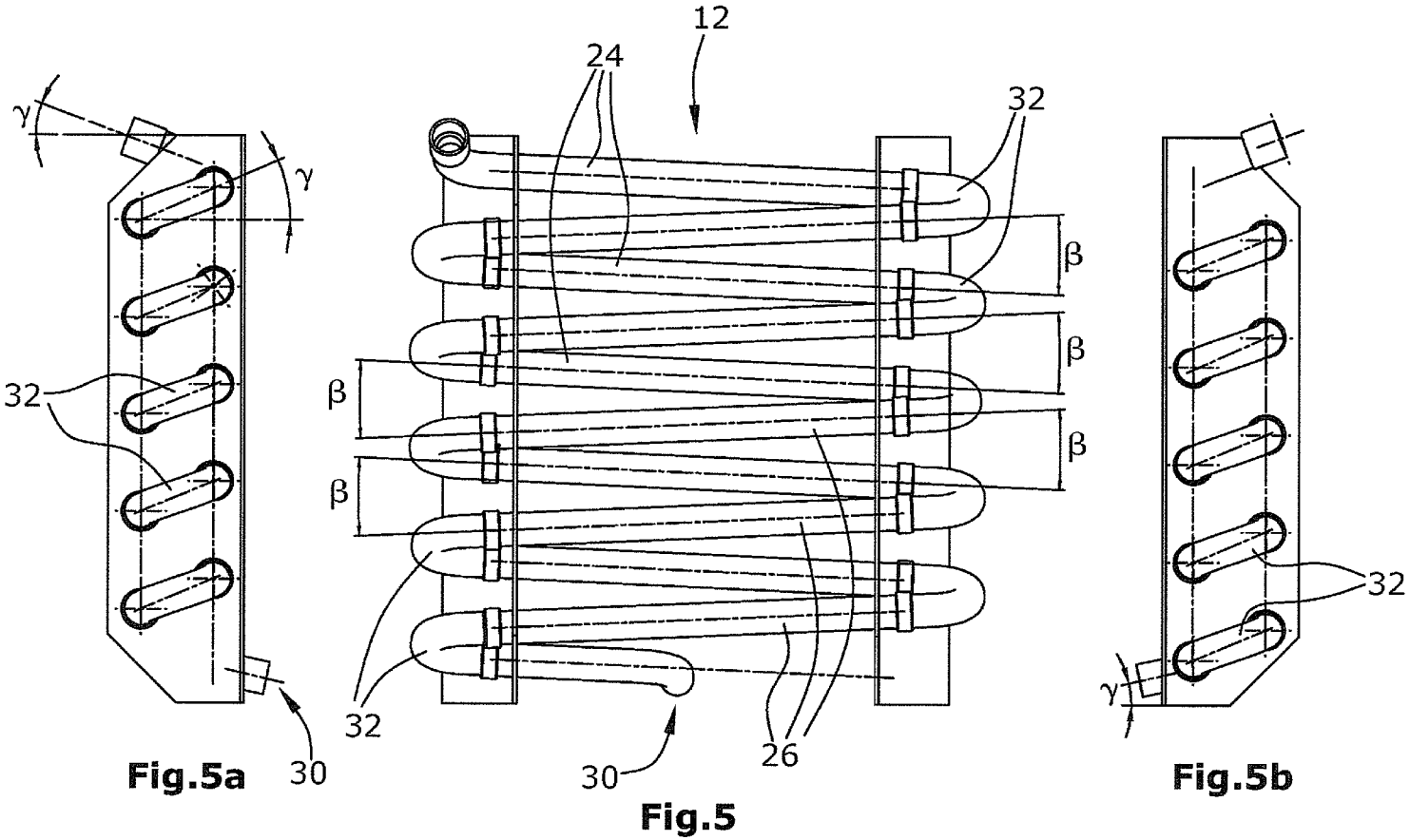
Figure 6:
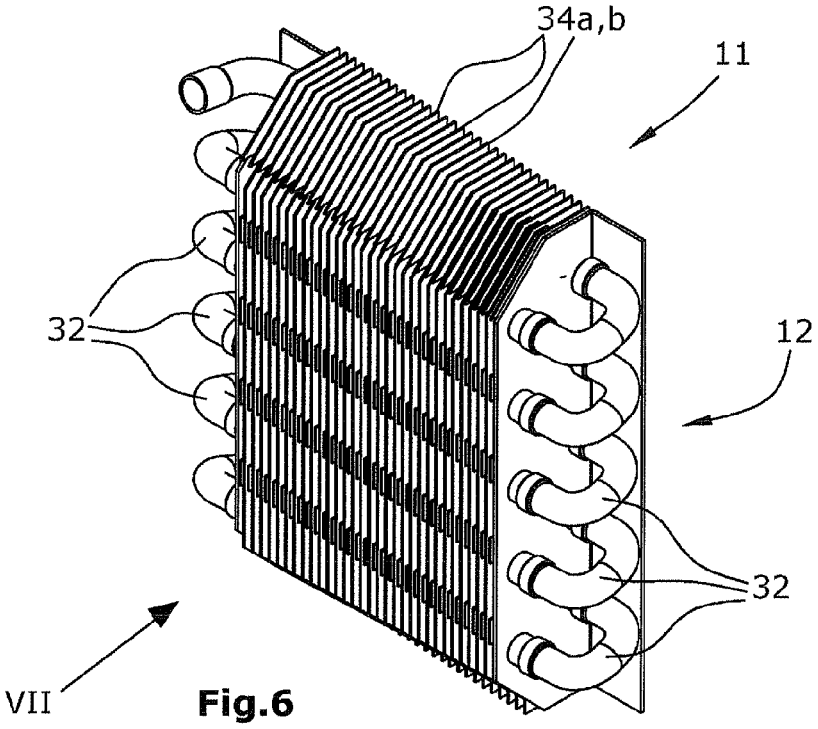
Figure 7:
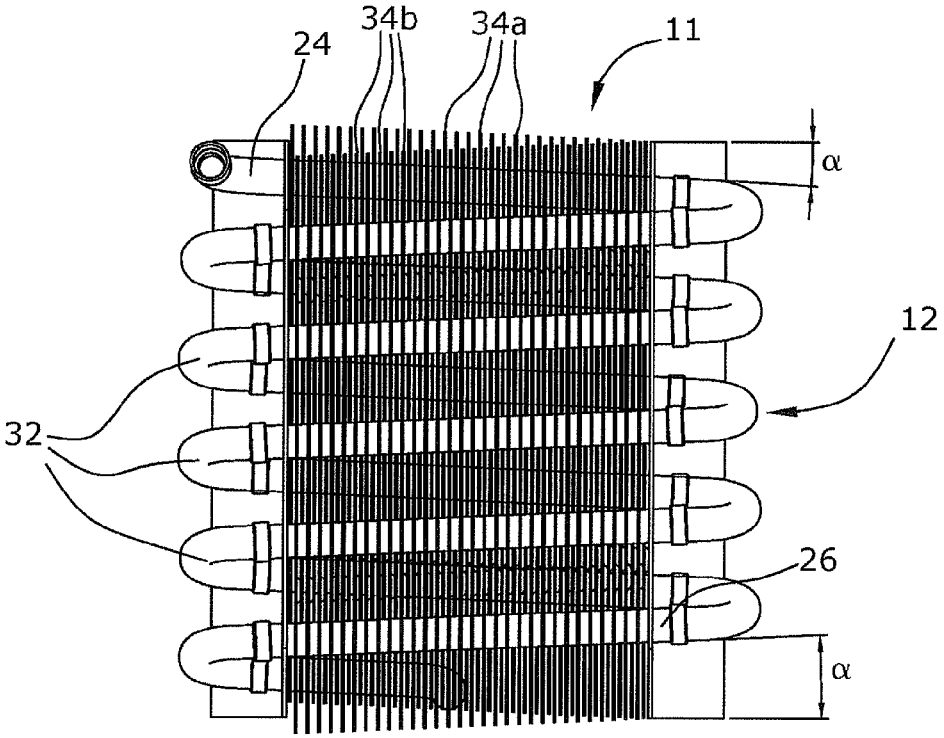
Figure 8:
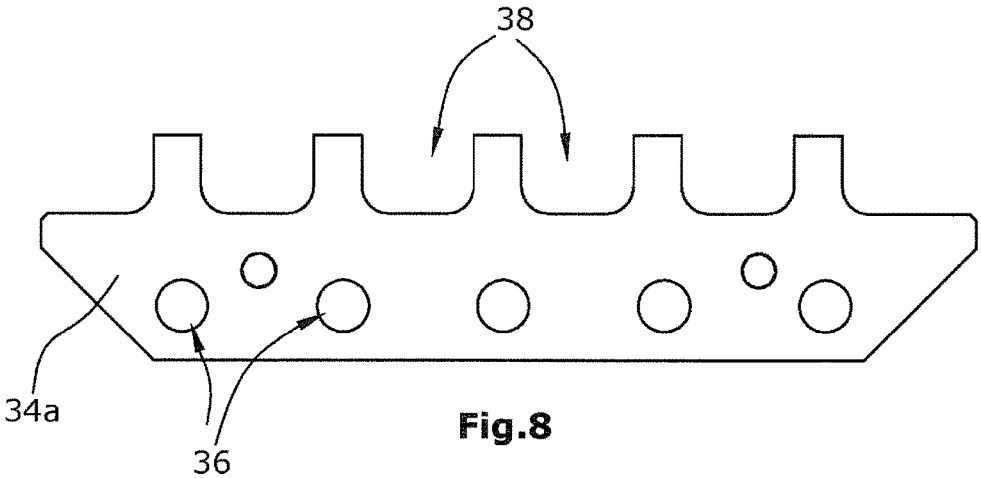
Figure 9:
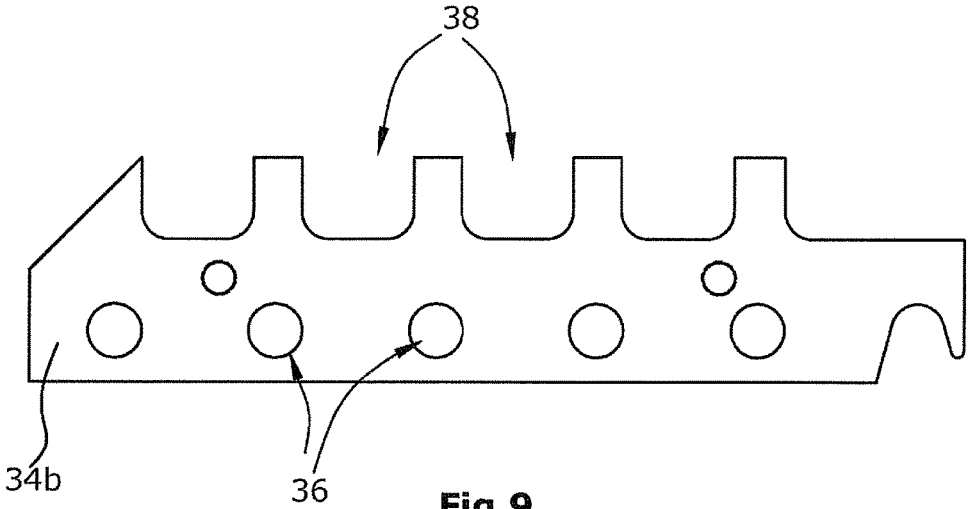

In the Figures:

FIG. 1 is an equivalent circuit diagram of the removal device,

FIG. 2 is a perspective view of the removal device with an upstream compressor, FIG. 3 shows a lateral section through the removal device, FIG. 4 is a perspective illustration of the pipeline assembly, FIG. 5 is a view seen in the direction of the arrow V in FIG. 4, FIG. 5*a* is a view seen in the direction of the arrow Va in FIG. 4, FIG. 5*b* is a view seen in the direction of the arrow Vb in FIG. 4, FIG. 6 shows the illustration of FIG. 4 with the cooling fins mounted, FIG. 7 is a view seen in the direction of the arrow VII in FIG. 6, FIG. 8 is a top plan view on a first cooling fin, and FIG. 9 is a top plan view on a second cooling fin.

The equivalent circuit diagram of FIG. 1 illustrates the removal device 10 of the present invention which consists of the cooling device 11, a compressor 14 arranged upstream in the fluid flow direction and, arranged further upstream, a quick release coupling 16 which is self-closing in both directions, and a plug 18 which is self-closing in both directions, as well as a quick release coupling 20 which is self-closing in both directions, and a plug 22 which is self-closing in both directions, both arranged downstream. The cooling device 11 is formed by a pipeline assembly 12 and cooling fins 34*a*, 34*b* on the pipeline assembly.

As illustrated in FIGS. 4 and 5, the pipeline assembly 12 consists of a plurality of straight pipeline elements 24, 26, a fluid inlet 28, a fluid outlet 30 and a plurality of connecting pipes 32 that each connect two successively arranged pipeline elements 24, 26 in a fluid conducting manner. In this regard, the pipeline elements 24 are stacked one above the other in a first plane that is parallel to a second plane in which the other pipeline elements 26 are arranged one above the other. As such, seen in the fluid flow direction, one pipeline element 24 of the first plane is arranged between pipeline elements 26 of the second plane. A pipeline element 26 of the second plane is arranged between pipeline elements 24 of the first plane, seen in the fluid flow direction. One pipeline element 24 of the first plane is respectively connected with two pipeline elements 26 of the second plane by two connecting pipes 32.

As illustrated in FIG. 5, adjacent pipeline elements 24, 26 of different planes, arranged one after the other in the fluid flow direction, are inclined relative to each other by an angle β of about 5°, i.e. 5° or 5.1°. In the lateral views in FIGS. 5*a* and 5*b*, seen in the direction of the arrows V*a* and V*b* in FIG. 4, the plane of the connecting pipes 32 is inclined by an angle γ of about 30° with respect to a horizontal plane. It can be seen in FIG. 7 that each pipeline element 24, 26 is inclined by an angle α of about 2.5° relative to a horizontal plane. From FIGS. 2 and 3 it can be seen that the plane of the pipeline elements 24 and the plane of the pipeline elements 26 are mutually parallel and are each arranged inclined by an angle δ relative to a vertical plane. The angle δ is about 20°.

FIGS. 6 and 7 illustrate the cooling fins 34*a*, 34*b* arranged in parallel to each other along the pipeline assembly 12. Here, a left cooling fin 34*a* of FIG. 8 is arranged beside a right cooling fin of FIG. 9. The cooling fins 34*a*, 34*b* are each provided with openings 36 in the form of holes for the pipeline elements 24 of the first plane. For the pipeline elements 26 of the second plane, each cooling fin 34*a*, 34*b* is provided with recesses 38. It can be seen in FIGS. 8 and 9 that the openings 36 and the recesses 38 are each arranged along a straight line. With respect to the two planes for the pipeline elements 24, 26, these two straight lines are also arranged in parallel with each other. Whereas the openings 36 fully surround the pipeline elements 24 of the first plane and contact them in a heat conductive manner, no contact with any pipeline element 24, 26, and in particular no thermal transfer, is provided in the region of each of the recesses 38.

The invention claimed is:

1. A removal device for removing a fluid from a refrigeration system, the removal device comprising:

a cooling device, wherein a fluid flows through the cooling device, wherein the cooling device includes a pipeline assembly, wherein the pipeline assembly includes a plurality of straight pipeline elements arranged and connected to each other one after the other in a direction of fluid flow, such that the straight pipeline elements are sequentially passed by the fluid, wherein the straight pipeline elements are arranged in two different, mutually parallel planes, wherein the pipeline assembly has a plurality of cooling fins, wherein each of the plurality of cooling fins includes openings for the straight pipeline elements of a first plane of the two different, mutually parallel planes, the openings being arranged along a first straight line, and recesses for the straight pipeline elements of a second plane of the two different, mutually parallel planes, the recesses being arranged along a second straight line parallel to the first straight line, wherein each of the plurality of cooling fins includes one discrete piece that includes the openings and the recesses, wherein the openings encompass and contact the straight pipeline elements of the first plane in a heat conductive manner and the recesses do not contact the straight pipeline elements of the second plane in a heat conductive manner;

a fluid inlet arranged upstream from the straight pipeline elements, and a fluid outlet arranged downstream from the straight pipeline elements, wherein the two different, mutually parallel planes that are inclined relative to a vertical plane and relative to a horizontal plane in such a way that all fluid entering through the fluid inlet flows within the straight pipeline elements to the fluid outlet by gravity; and a compressor arranged upstream from the cooling device, wherein the fluid flows through the compressor, wherein the compressor is connected to the fluid inlet such that compressed fluid flows from the compressor to the fluid inlet and enters the straight pipeline elements through the fluid inlet.

2. The removal device of claim 1, wherein a first and second straight pipeline element of the straight pipeline elements are inclined by an angle β with respect to each other, wherein the first and second straight pipeline element are arranged and connected one after the other in the fluid flow direction.

3. The removal device of claim 2, wherein the inclination angle β between the first and second straight pipeline elements arranged one behind the other ranges from 1° to 9°.

4. The removal device of claim 2, wherein the first and second straight pipeline elements arranged one behind the other in the fluid flow direction are connected with each other by U-shaped connecting pipes arranged in a plane inclined by an angle γ relative to a horizontal plane.

5. The removal device of claim 4, wherein the inclination angle γ of the plane of the connecting pipes is from 10° to 50°.

6. The removal device of claim 4, wherein the inclination angle γ of the plane of the connecting pipes is from 25° to 35°.

7. The removal device of claim 4, wherein the inclination angle γ of the plane of the connecting pipes is 30° relative to the horizontal plane.

8. The removal device of claim 2, wherein the inclination angle β ranges from 3° to 7°.

9. The removal device of claim 2, wherein the inclination angle β is 5°.

10. The removal device of claim 1, wherein the inclination δ of the planes of the pipeline elements with respect to the vertical plane is from 5° to 35°.

11. The removal device of claim 1, wherein a first and second straight pipeline elements of the straight pipeline elements are respectively arranged in different planes, wherein the first and second straight pipeline elements are arranged one after the other in the fluid flow direction.

12. The removal device of claim 1, wherein, seen in the flow direction, at least one self-closing plug or at least one self-closing quick release coupling is arranged upstream of the compressor or downstream of the fluid outlet or at least one self-closing plug or at least one self-closing quick release is arranged upstream of the compressor and downstream of the fluid outlet.

13. The removal device of claim 1, wherein the inclination δ of the planes of the first and second straight pipeline elements with respect to the vertical plane is from 15° to 25°.

14. The removal device of claim 1, wherein the inclination δ of the planes of the first and second straight pipeline elements with respect to the vertical plane is 20°.

15. A removal device for removing a fluid from a refrigeration system, the removal device comprising:

a cooling device, wherein a fluid flows through the cooling device, wherein the cooling device includes a pipeline assembly, wherein the pipeline assembly includes a plurality of straight pipeline elements connected to each other, a fluid inlet arranged upstream of the straight pipeline elements, and a fluid outlet arranged downstream of the straight pipeline elements, wherein the fluid flows sequentially from a first straight pipeline element of the plurality of straight pipeline elements to a second straight pipeline element of the plurality of straight pipeline elements to a third straight pipeline element of the plurality of straight pipeline elements, wherein the second straight pipeline element is angled with respect to the first straight pipeline element and the third straight pipeline element, wherein the first, second, and third straight pipeline elements are angled with respect to a horizontal plane in such a way that all fluid entering through the fluid inlet flows within the first, second, and third straight pipeline elements to the fluid outlet by gravity, wherein the first straight pipeline element is connected to the second straight pipeline element by a first bent connecting pipe, wherein the second straight pipeline element is connected to the third straight pipeline element by a second bent connecting pipe, wherein the pipeline assembly has a plurality of cooling fins, wherein each of the plurality of cooling fins includes openings for the straight pipeline elements of a first plane, the openings being arranged along a first straight line, and recesses for the straight pipeline elements of a second plane, the recesses being arranged along a second straight line parallel to the first straight line, wherein each of the plurality of cooling fins includes one discrete piece that includes the openings and the recesses, wherein the openings encompass and contact the straight pipeline elements of the first plane in a heat conductive manner and the recesses do not contact the straight pipeline elements of the second plane in a heat conductive manner; and a compressor arranged upstream of the cooling device, wherein the fluid flows through the compressor, wherein the compressor is connected to the fluid inlet such that compressed fluid flows from the compressor to the fluid inlet.

16. The removal device of claim 15, wherein the first and third straight pipelines are generally parallel.

* * * * *